US007097505B1

(12) United States Patent
Shanahan et al.

(10) Patent No.: US 7,097,505 B1
(45) Date of Patent: Aug. 29, 2006

(54) SHIELDED ELECTRICAL CONNECTOR

(75) Inventors: Maurice Shanahan, Limerick (IE); Eugene Folan, Galway (IE)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/311,889

(22) Filed: Dec. 19, 2005

(51) Int. Cl.
*H01R 13/648* (2006.01)
*H01R 24/04* (2006.01)

(52) U.S. Cl. ..... 439/607; 439/668

(58) Field of Classification Search ..... 439/607, 439/668, 669
See application file for complete search history.

(56) References Cited

U.S. PATENT DOCUMENTS 5,676,569 A 10/1997 Davis
5,769,666 A * 6/1998 Wu ..... 439/620
5,984,726 A 11/1999 Wu
6,109,967 A 8/2000 Chiou
6,217,378 B1 * 4/2001 Wu ..... 439/567
6,368,154 B1 * 4/2002 Hirata et al. ..... 439/609
6,371,771 B1 * 4/2002 Fan ..... 439/79
2005/0075010 A1 * 4/2005 Yang et al. ..... 439/607

* cited by examiner

*Primary Examiner*—Tho D. Ta
(74) *Attorney, Agent, or Firm*—Stephen Z. Weiss

(57) ABSTRACT

A shielded electrical connector includes a dielectric housing having a front mating end, a rear terminating end and a plug-receiving cavity extending into the housing from the front mating end thereof. A conductive shield substantially surrounds the housing and has a front end, a rear end and at least one flexible arm extending from the rear end toward the front end of the shield. The flexible arm has a flared distal end for engaging a mating plug inserted into the cavity. The shield has an aperture aligned with the distal end of the flexible arm and into which the distal end can flex to increase the flexure range of the arm. A terminal is mounted on the housing and extends forwardly into the cavity for engaging an appropriate terminal of the mating plug.

14 Claims, 3 Drawing Sheets

SHIELDED ELECTRICAL CONNECTOR

FIELD OF THE INVENTION

This invention generally relates to the art of electrical connectors and, particularly, to a shielded connector.

BACKGROUND OF THE INVENTION

Shielded electrical connector typically include some form of dielectric housing mounting one or more conductive terminals for engaging the terminal(s) of a complementary mating connector. At least portions of the dielectric housing are covered by a metal shield which protects the connecting interface from EMI and/or RF interference. The shield often has one or more tabs, arms or other structural components which flexibly engage a shield of the mating connector.

With the ever-increasing miniaturization of electronics and electrical components, it has become increasing difficult to design and manufacture shielded electrical connectors which are strong and which provide a good, positive mechanical engagement between the shield of the connector and the shield of the mating connector. The present invention is directed to solving these problems.

SUMMARY OF THE INVENTION

An object, therefore, of the invention is to provide a new and improved shielded electrical connector of the character described.

In the exemplary embodiment of the invention, the connector includes a dielectric housing having a front mating end, a rear terminating end and a plug-receiving cavity extending into the housing from the front mating end thereof. A conductive shield substantially surrounds the housing and has a front end, a rear end and at least one flexible arm extending from the rear end toward the front end of the shield. The flexible arm has a flared distal end for engaging a mating plug inserted into the cavity. The shield has an aperture aligned with the distal end of the flexible arm and into which the distal end can flex to increase the flexure range of the arm. A terminal is mounted on the housing and extends forwardly into the cavity for engaging an appropriate terminal of the mating plug.

As disclosed herein, the conductive shield is stamped and formed of sheet metal material. A pair of the flexible arms and respective apertures are disposed on diametrically opposite sides of the cavity.

According to one aspect of the invention, the flexible arms have abutment portions behind the distal ends of the arms. The abutment portions engage side walls of the shield to prevent over-flexing of the arms.

According to other aspects of the invention, the dielectric housing includes a pair of slots through which at least the distal ends of the flexible arms project into the cavity. A side of the conductive shield extends between the front and rear ends thereof and lies in a plane for securement to an appropriate mounting pad on a printed circuit board. In the exemplary embodiment, the connector is a DC power jack, and the terminal comprises a terminal pin projecting forwardly into the cavity, along with a tail portion for connection to the circuit board.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures, and in which:

DETAILED DESCRIPTION OF THE PREFERRED EMBODIMENT

Figure 1:
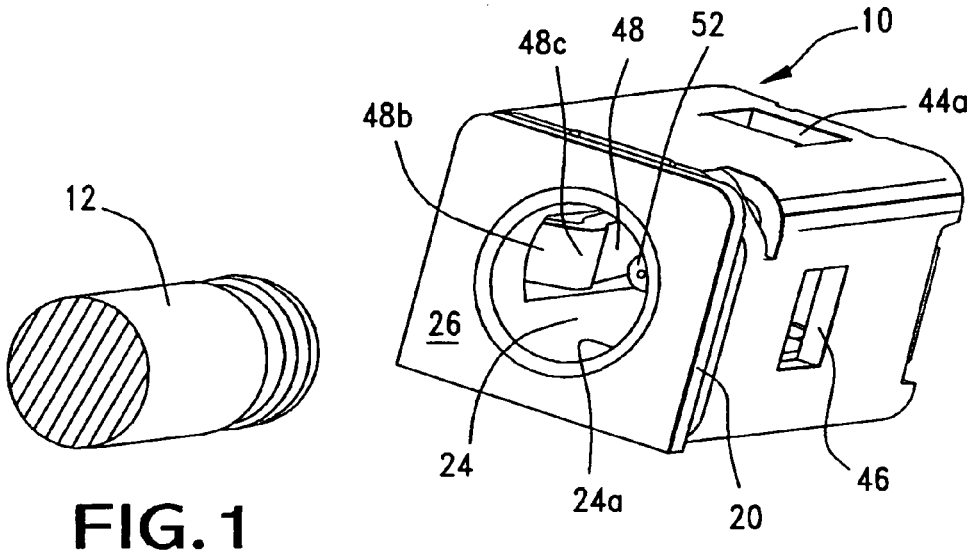
FIG. 1 is a front perspective view of a shielded electrical connector according to the invention, in conjunction with a mating plug.
Figure 2:
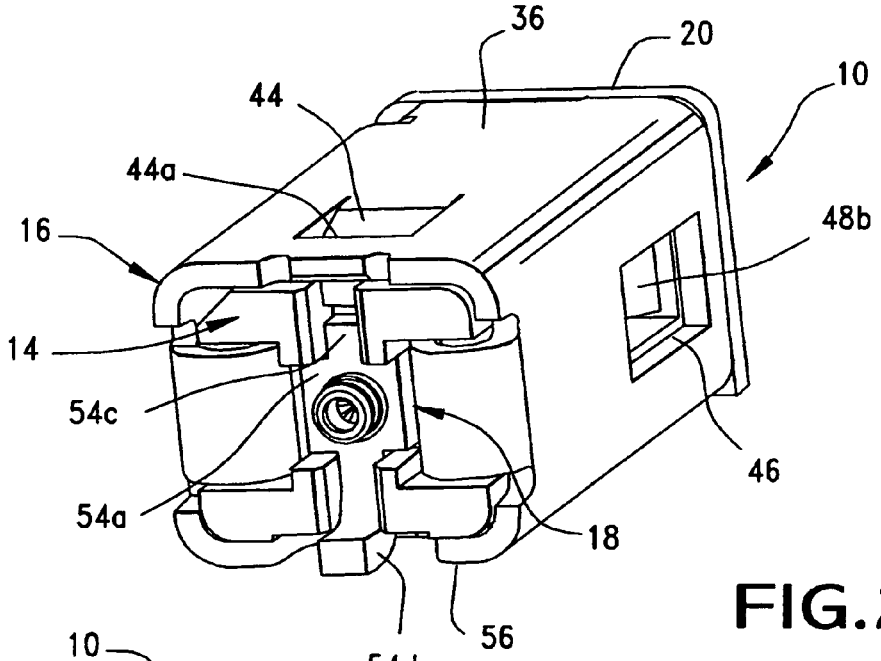
FIG. 2 is a rear perspective view of the connector.
Figures 3, 4:
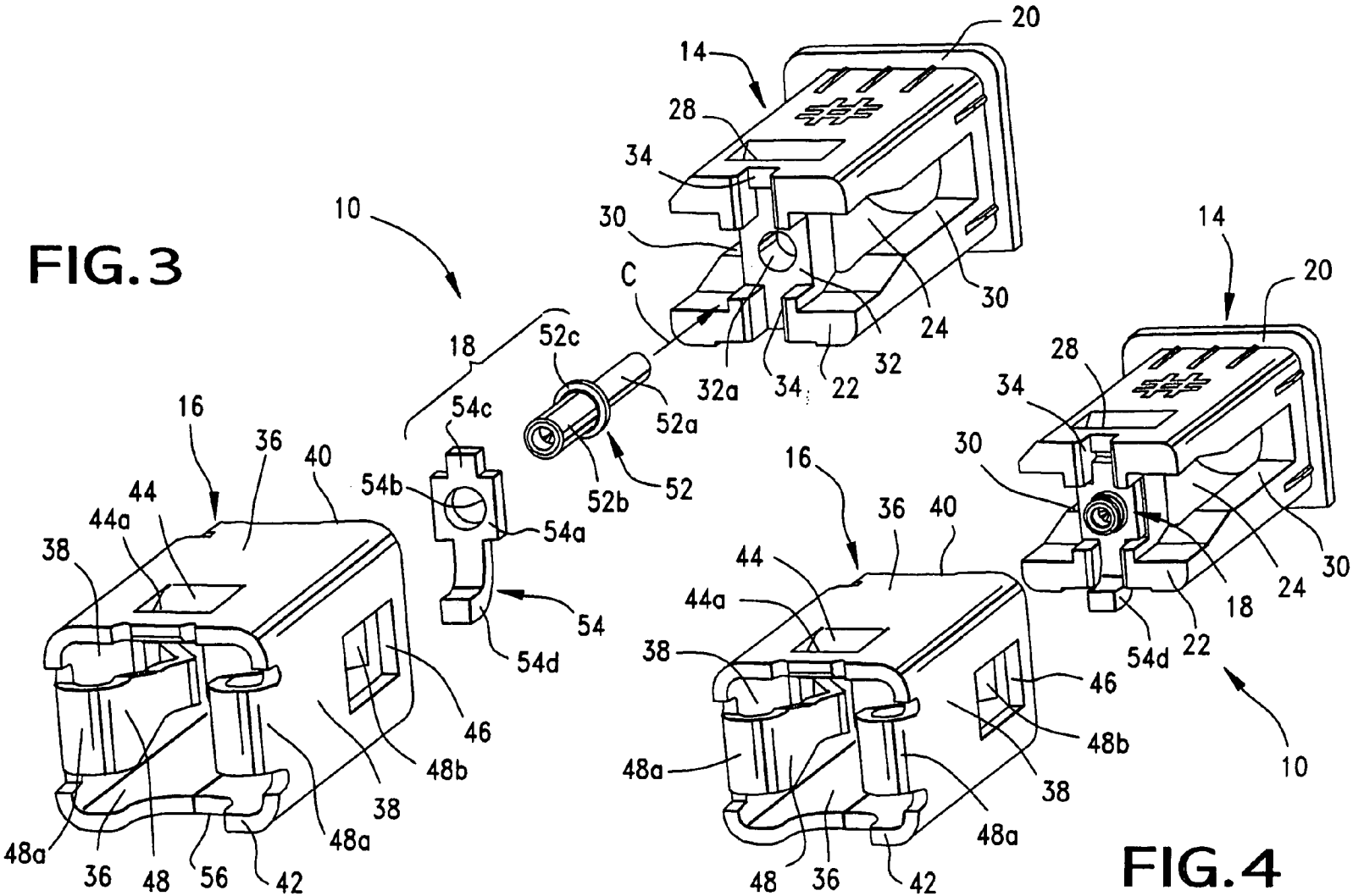
FIG. 3 is a rear, exploded perspective view of the connector.
FIG. 4 is a view similar to that of FIG. 3, with the terminal assembly mounted on the housing.

Referring to the drawings in greater detail, and first to FIGS. 1–3, the invention is embodied in a shielded electrical connector, generally designated 10, for mating with a complementary mating plug 12 (FIG. 1) of the coaxial type. As best seen in FIG. 3, the connector is a DC power jack and includes three basic components, namely: a dielectric housing, generally designated 14; a conductive shield, generally designated 16; and a terminal assembly, generally designated 18.

More particularly, housing 14 includes a front mating end defined by an outwardly projecting peripheral flange 20, a rear terminating end 22 and a plug-receiving cavity 24 extending into the housing from the front mating end thereof. As best seen in FIG. 1, cavity 24 has a front opening 24*a* in a flat front face 26 of the housing. The housing is a one-piece structure unitarily molded of dielectric material such as plastic or the like.

Still further, dielectric housing 14 is generally square or rectangular in cross-section and includes a pair of latch apertures in two diametrically opposite sides thereof, and a pair of slots 30 in the other two diametrically opposite sides thereof. As best seen in FIG. 3, the housing includes a rear mounting block 32 having a through hole 32*a* for mounting terminal assembly 18, as described hereinafter. A pair of mounting grooves 34 are formed in rear end 22 of the housing, and the grooves extend generally radially of through hole 32*a*.

Conductive shield 16 of connector 10 is a one-piece structure and may be fabricated of stamped and formed sheet metal material. As best seen in FIG. 3, the shield is generally square or rectangular in cross-section to fit over the similarly configured housing 14 behind front flange 20. The shield substantially surrounds the housing behind the flange as seen in FIGS. 1 and 2. The shield has a pair of opposite side walls 36 and a pair of opposite side walls 38 which combine to form a generally hollow structure. The side walls define a front end 40 and a rear end 42 of the shield. A pair of resilient latch tabs 44 are stamped and formed out of a pair of openings 44*a* in opposite side walls 36 of the shield. The latch tabs are bent inwardly for engaging latch apertures 28 of housing 14 as described hereinafter. A pair of openings 46 are stamped out of side walls 38, again for purposes described hereinafter. Finally, conductive shield 16 includes a pair of flexible arms 48 which are bent inwardly, as at 48*a*, so that the arms extend from rear end 42 toward front end 40 inside the hollow shield.

Figure 5:
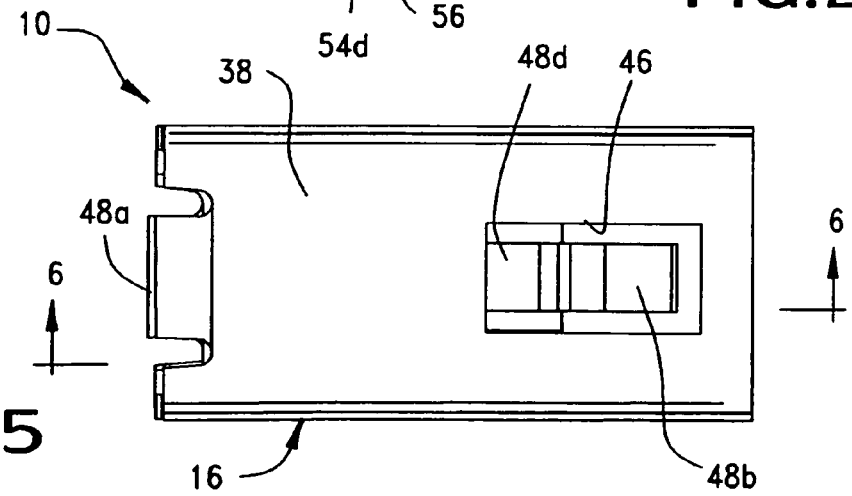
FIG. 5 is a side elevational view of the connector.
Figure 6:
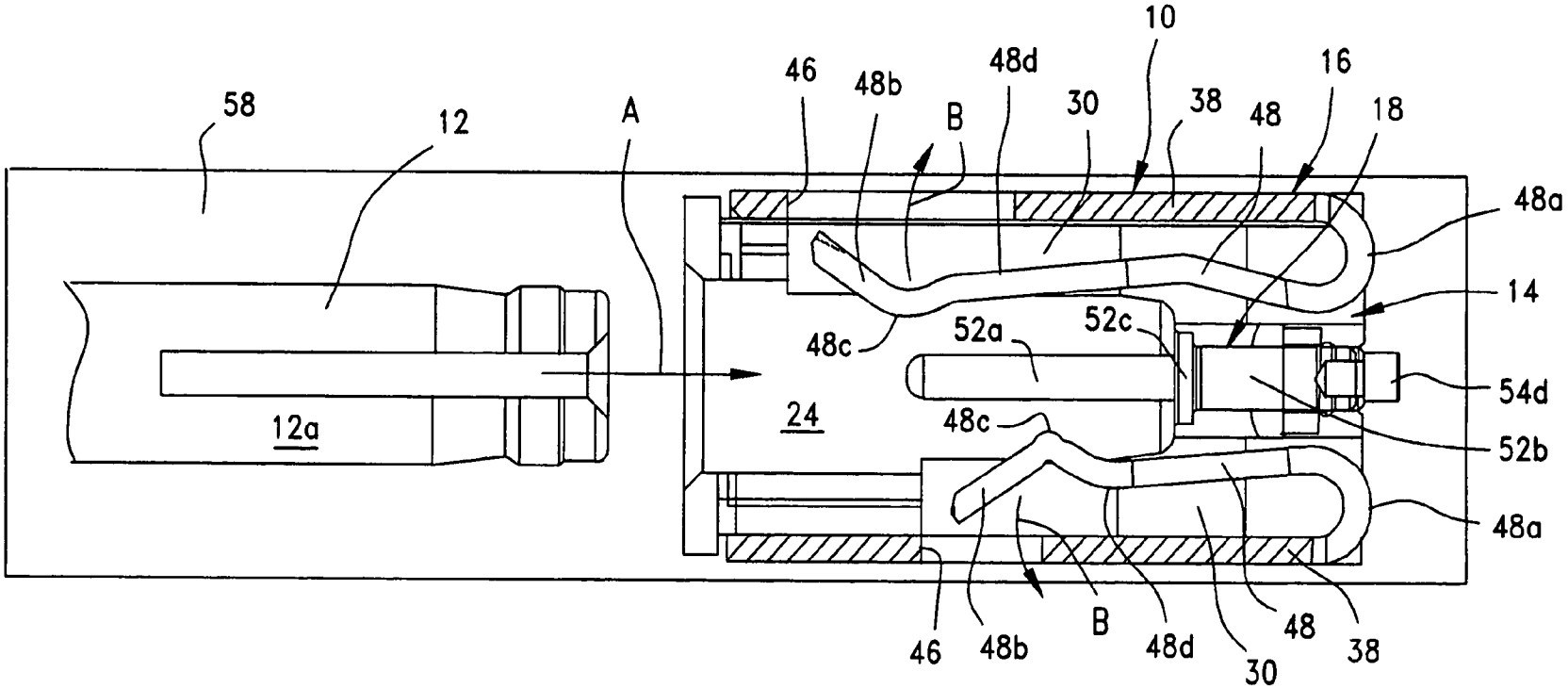
FIG. 6 is a vertical section taken generally along line 6—6 in FIG. 5, in conjunction with the mating plug shown in FIG. 1.

Referring to FIG. 6 in conjunction with FIGS. 1–3, flexible arms 48 have outwardly flared distal ends 48*b* for guiding mating plug 12 into connector 10 in the direction of arrow "A" (FIG. 6). The insides of the distal ends define contact points 48*c* for engaging the outside surface of a shield 12*a* of mating plug 12. The flexible arms also have abutment portions 48*d* behind or rearwardly of the distal ends of the arms. It can be seen in FIG. 5 that apertures 46 in side walls 38 of the shield are aligned with the distal ends of the flexible arms.

The operation or function of flexible arms 48 now will be described. Referring specifically to FIGS. 5 and 6, when mating plug 12 is inserted into cavity 24 of housing 14 in the direction of arrow "A", the outwardly flared distal ends 48*b* of the arms will guide the plug into the cavity, as contact points 48*c* on the insides of the arms engage the outside of shield 12*a* of the plug. This biases the flexible arms outwardly in the direction of arrows "B" as the arms are free to flex within slots 30 in the housing. With apertures 46 in side walls 38 of the shield being aligned with the distal ends of the arms, the flexure range of the arms is increased, because the flared distal ends of the arms can actually project through the apertures and not be stopped by the side walls of the shield. This provides a good, strong and positive mechanical engagement between the flexible arms of shield 16 and shield 12*a* of mating plug 12. On the other hand, abutment portions 48*d* of the flexible arms can engage the inside surfaces of side walls 38 of the shield to prevent over-flexing of the flexible arms. Significantly, the flexible arms are unitary portions of the singular shield 16 and are not separate components.

Referring back to FIG. 3, terminal assembly 18 is a two-part assembly, including a terminal pin, generally designated 52, and a mounting bracket, generally designated 54. The terminal pin includes a forwardly projecting pin portion 52*a* which projects into cavity 24 as best seen in FIG. 6, for mating engagement with mating plug 12. The terminal pin also includes a somewhat larger diameter rear portion 52*b*, with a radially outwardly projecting, annular flange 52*c* between the forward pin portion and the enlarged rear portion. Mounting bracket 54 includes a body portion 54*a* having a through hole 54. A stabilizing tab 54*c* projects from one side of the body portion, and an L-shaped tail portion 54*d* projects from the opposite side of the body portion.

The assembly of terminal assembly 18 to the rear of dielectric housing 14 now will be described. Specifically, terminal pin 52 is assembled by inserting pin portion 52*a* into through hole 32*a* of mounting block 32 of the housing, in the direction of arrow "C" (FIG. 3). The terminal pin is inserted until flange 52*c* abuts against the rear face of mounting block 32. Mounting bracket 54 then is assembled in the direction of arrow "C", with stabilizing tab 54*c* and tail portion 54*d* of the mounting bracket being press-fit into mounting grooves 34 at the rear of the housing. Rear portion 52*b* of the terminal pin projects through hole 54*b* in body portion 54*a* as best seen in the fully assembled position of FIG. 4.

Of course, terminal pin assembly 18 can be assembled to housing 14 after conductive shield 16 is assembled to the housing, if desired. When assembling shield 16 to the housing, the shield is moved forwardly over the housing until front end 40 of the shield abuts against the front flange 20 of the housing. At that point, resilient latch tabs 44 of the shield "snap" into latch apertures 28 of the housing to lock the shield to the housing as seen in FIGS. 1, 2, 5 and 6.

Finally, connector 10 is designed for mounting on a printed circuit board. To that end, and referring to FIGS. 2 and 3, the bottom surface 56 of the bottom side wall 36 of the shield is generally flat, as is all of the other side walls of the shield. The bottom surface of tail portion 54*d* of mounting bracket 54 of terminal assembly 18 also is flat and is generally flush with bottom surface 56. Therefore, the connector can be mounted on top of a printed circuit board 58 as shown in FIG. 6. Bottom surface 56 (FIGS. 2 and 3) of the shield can be solder connected to a mounting pad on the printed circuit board. Tail portion 54*d* of the mounting bracket of terminal assembly 18 can be solder connected to an appropriate circuit trace on the printed circuit board.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A shielded electrical connector, comprising:

a dielectric housing having a front mating end, a rear terminating end and a plug-receiving cavity extending into the housing from the front mating end thereof;

a conductive shield substantially surrounding the housing and having a front end, a rear end and a pair of flexible arms extending from the rear end toward the front end of the shield inside the cavity, the flexible arms having flared distal ends for engaging a mating plug inserted into said cavity, the shield having apertures aligned with the distal ends of the flexible arms and into which the distal ends can flex to increase the flexure range of the arms; and a terminal mounted on the housing and extending forwardly into the cavity for engaging an appropriate terminal of the mating plug.

2. The shielded electrical connector of claim 1 wherein said conductive shield is stamped and formed of sheet metal material.

3. The shielded electrical connector of claim 1 wherein said dielectric housing includes a pair of slots through which at least the distal ends of the flexible arms project into the cavity.

4. The shielded electrical connector of claim 1 wherein said flexible arms have abutment portions rearwardly of the distal ends of the arms for engaging side walls of the shield to prevent over-flexing of the arms.

5. The shielded electrical connector of claim 1 wherein a side of the conductive shield extending between the front and rear ends thereof lies in a plane for securement to an appropriate mounting pad on a printed circuit board.

6. The shielded electrical connector of claim 1 wherein said flexible arms and respective apertures are disposed on diametrically opposite sides of the cavity.

7. The shielded electrical connector of claim 1 wherein the connector is a DC power jack, and said terminal comprises a terminal pin projecting forwardly into the cavity.

8. A shielded electrical connector, comprising:

a dielectric housing having a front mating end, a rear terminating end, a plug-receiving cavity extending into the housing and a pair of slots at diametrically opposite sides of the housing;

a conductive shield stamped and formed of sheet metal material and substantially surrounding the housing, the shield having a front end, a rear end and a pair of flexible arms extending from the rear end toward the front end of the shield inside the cavity, the flexible arms being aligned with the slots in the housing and having flared distal ends for engaging a mating plug inserted into said cavity, the shield having apertures aligned with the distal ends of the flexible arms and into which the distal ends can flex to increase the flexure range of the arms, the flexible arms having abutment portions rearwardly of the distal ends of the arms for engaging side walls of the shield to prevent over-flexing of the arms; and a terminal mounted on the housing and extending forwardly into the cavity for engaging an appropriate terminal of the mating plug.

9. The shielded electrical connector of claim 8 wherein a side of the conductive shield extending between the front and rear ends thereof lies in a plane for securement to an appropriate mounting pad on a printed circuit board.

10. A shielded electrical connector, comprising:

a dielectric housing having a front mating end, a rear terminating end and a mating cavity; and a conductive shield about at least portions of the housing and having a front end, a rear end and at least one flexible arm extending from the rear end toward the front end of the shield, the flexible arm having a distal end for engaging a mating connector component inserted into the cavity, the shield having an aperture aligned with the distal end of the flexible arm and into which the distal end can flex to increase the flexure range of the arm;

wherein the flexible arm has an abutment portion rearwardly of the distal end of the arm for engaging a side wall of the shield to prevent over-flexing of the arm.

11. The shielded electrical connector of claim 10 wherein said conductive shield is stamped and formed of sheet metal material.

12. The shielded electrical connector of claim 10 wherein said dielectric housing includes a slot through which at least the distal end of the flexible arm projects into the cavity.

13. The shielded electrical connector of claim 10 wherein a side of the conductive shield extending between the front and rear ends thereof lies in a plane for securement to an appropriate mounting pad on a printed circuit board.

14. The shielded electrical connector of claim 10 wherein the connector is a DC power jack, and said terminal comprises a terminal pin projecting forwardly into the cavity.

* * * * *